US006715435B1

(12) United States Patent
Wieczorek et al.

(10) Patent No.: US 6,715,435 B1
(45) Date of Patent: Apr. 6, 2004

(54) SEWING MACHINE FOR CLOSE-TOLERANCE STITCHING

(75) Inventors: Joseph Wieczorek, Lake Orion, MI (US); Patricia M. Woollcott, Oak Park, MI (US)

(73) Assignee: Irvin Automotive Products, Inc., Auburn Hills, MI (US)

( * ) Notice: Subject to any disclaimer, the term of this patent is extended or adjusted under 35 U.S.C. 154(b) by 0 days.

(21) Appl. No.: 10/348,140

(22) Filed: Jan. 20, 2003

(51) Int. Cl.[7] ..... D05B 35/10; D05B 79/00
(52) U.S. Cl. ..... 112/475.03; 112/272; 112/470.07
(58) Field of Search ..... 112/475.03, 470.07, 112/153, 306, 272, 277

(56) References Cited

U.S. PATENT DOCUMENTS

| | | | | |
|---|---|---|---|---|
| 4,270,472 A | | 6/1981 | Suzuki et al. | |
| 4,342,271 A | | 8/1982 | Socha | |
| 4,481,507 A | | 11/1984 | Takiguchi et al. | |
| 4,823,716 A | | 4/1989 | Nakashima | |
| 4,827,858 A | | 5/1989 | Horie et al. | |
| 4,829,194 A | * | 5/1989 | LeClaire | 250/559.36 |
| 4,995,328 A | | 2/1991 | Tanaka | |
| 4,998,493 A | | 3/1991 | Tanaka | |
| 5,000,105 A | | 3/1991 | Tanaka | |
| 5,042,410 A | | 8/1991 | Nakashima | |
| 5,078,067 A | | 1/1992 | Nakashima | |
| 5,415,118 A | * | 5/1995 | Adamski, Jr. et al. | 112/153 X |
| 6,138,594 A | | 10/2000 | Kito | |

* cited by examiner

*Primary Examiner*—Peter Nerbun
(74) *Attorney, Agent, or Firm*—Dinnin & Dunn, P.C.

(57) ABSTRACT

The present invention provides a sewing machine for positioning a line of stitches a predetermined distance from an edge of a workpiece. The edge tracing sewing machine includes a machine body with a reciprocable needle mounted therein. The needle is reciprocated between an upward and a downward position at which it pierces a moving workpiece, passing a thread therethrough. The edge tracing sewing machine also includes a plurality of illuminable units that communicate stitch positioning to a machine operator, allowing the operator to manually adjust the lateral position of the workpiece, maintaining the stitch positioning within a predetermined tolerance from specifications.

20 Claims, 3 Drawing Sheets

SEWING MACHINE FOR CLOSE-TOLERANCE STITCHING

TECHNICAL FIELD

The present invention relates generally to sewing machines and sewing processes, and more particularly to a sewing machine or process for positioning a stitching line within a predetermined tolerance.

BACKGROUND OF THE INVENTION

Over the years, engineers have developed a great variety of electronic sewing machines. Devices having automatic control and sensing functions have been conceived, many meeting with great success, however, designers are always searching for improvements in stitching precision and accuracy. For instance, myriad circumstances exist in which it is desirable to place a line of stitches within a minimum distance from a selected stitching reference. When following a sewing pattern that has been printed, drawn, or even projected onto a workpiece, it may be crucial for success of the project that the stitches deviate no more than a given "tolerance" from their intended position. One instance in which it is particularly desirable to position stitches precisely is when tracing an edge of a workpiece, for example when joining two overlaying pieces of fabric at their respective edges. If the operator sews the pieces too close to the edge, the seam may be too weak, allowing the stitches to pull out, and the fabric pieces to separate. Where two pieces of fabric tightly enclose a packed interior, for instance a filled cushion, this can be particularly problematic. If the operator positions the stitches too far from the workpiece edges, interior volume can be sacrificed, and cosmetic appearance compromised.

One device directed to positioning stitches along a workpiece edge is disclosed in U.S. Pat. No. 5,042,410 to Nakashima. Nakashima provides a bed and a reciprocable sewing needle mounted in a swinging mechanism for swinging the needle in a direction across the feeding direction of the workpiece. Further, Nakashima provides a detector for detecting the fabric edge, and a margin setting mechanism for setting the appropriate sewing margin from the edge of the workpiece. Based on the needle position and the workpiece edge position, a reference stitching line can be projected by a light projector onto the workpiece, serving as a guideline for positioning the fabric edge and/or the stitching line. Thus, the machine operator can manually control the position of the workpiece, following the projected stitching line.

Accompanying improvements in stitching precision have been developments in detecting and informing an operator when erroneous or undesirable machine conditions are encountered. In certain of these machines, a device is illuminated to signal the detection of an erroneous condition or event to a machine operator. U.S. Pat. No. 5,078,067 to Nakashima is directed to informing an operator of undesirable operating conditions. Nakashima provides a sewing machine with illuminating means for illuminating with light of different colors the sewing area on which an operator is working. Nakashima is relatively complex, and requires a separate motor to rotate a series of colored filters in front of a light source to change the color of projected light.

U.S. Pat. No. 6,138,594 to Kito et al is entitled Electronically Controlled Sewing Machine, and provides an informing device that visually (or aurally) informs a user which of several operations of the sewing machine is possible or impossible by illuminating LEDs of different colors to correspond to different conditions. One such indication communicated to the operator is whether the position of the sewing needle is within a desired position range above a needle plate. Kito, however, is relatively complex.

SUMMARY OF THE INVENTION

In one aspect, the present invention provides a sewing machine. The machine has a machine body affixed to a mounting plate and a reciprocable sewing needle attached to the machine body. The needle is movable between a retracted position and an extended position at which a needle tip pierces a laterally moving workpiece along a stitching line and passes a sewing strand or thread through the workpiece. A detector is also provided for determining a lateral position of the needle relative to the workpiece. The present invention also provides a plurality of lamps operably linked to the detector, wherein illumination of one of the plurality of lamps occurs at a first condition wherein a stitching line is positioned less than a predetermined tolerance distance from a selected position. Illumination of a second of the plurality of lamps occurs at a second condition wherein the stitching line is positioned greater than the predetermined tolerance distance from the selected position.

In another aspect, the present invention provides a method of positioning a stitching line within a predetermined range of distances from a workpiece edge. The method includes the steps of selecting a distance range for positioning a stitching line laterally of a workpiece edge, the distance range comprising a minimum distance and a maximum distance. The method also includes the step of feeding a workpiece past a reciprocable needle in a sewing machine, wherein the sewing machine is operable to serially pass an end of the needle through the translating workpiece, forming stitches therethrough, and the step of detecting a lateral position of the stitches relative to an edge of the workpiece. The method also includes the steps of operating an illumination means to a first state when the stitches are positioned greater than the minimum distance and less than the maximum distance from the workpiece edge, and operating the illumination means to a second state when the stitches are positioned less than the minimum distance or greater than the maximum distance from the workpiece edge.

DETAILED DESCRIPTION

Figure 1:
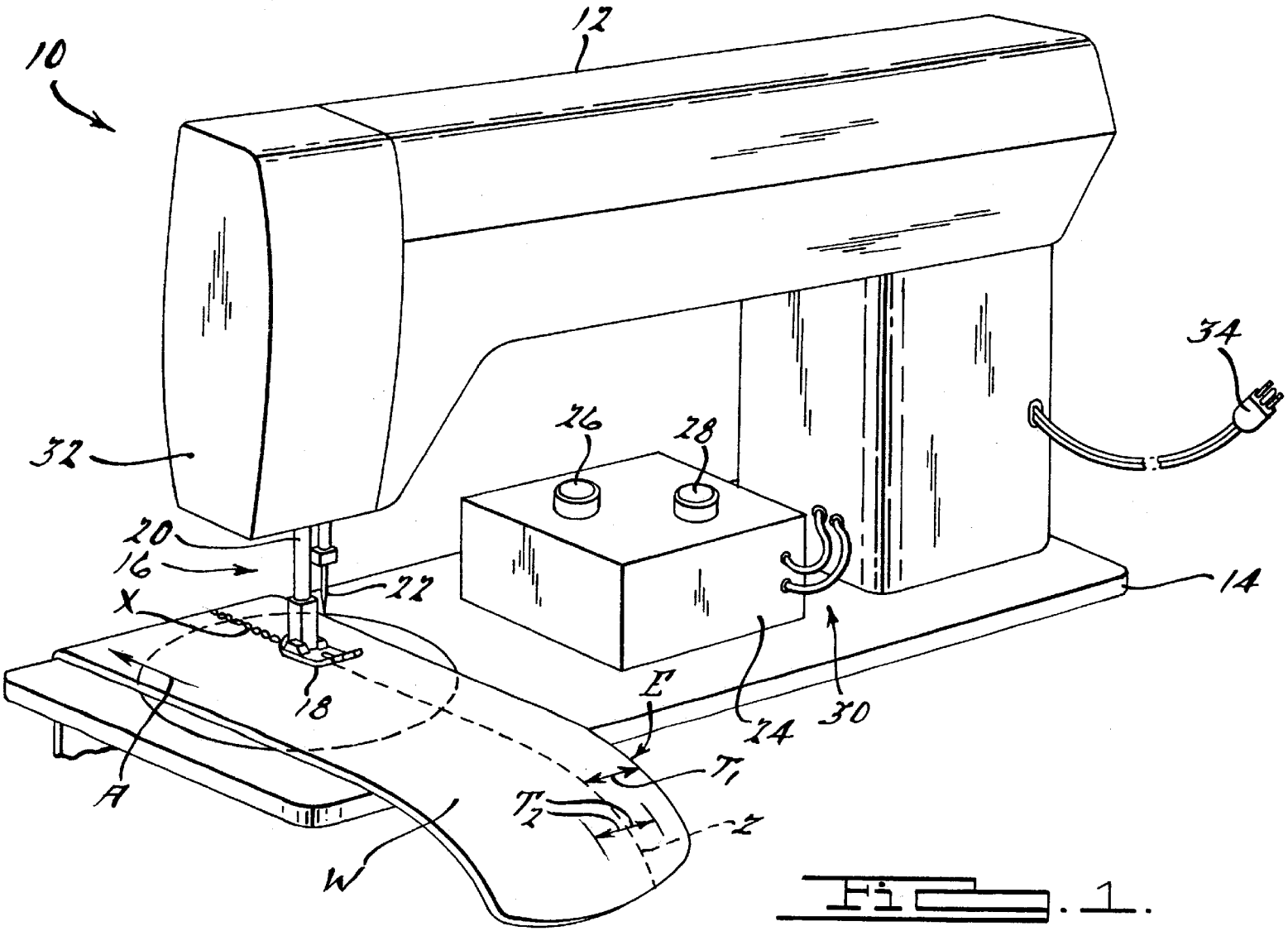
FIG. 1 is a perspective view of a sewing machine according to a preferred embodiment of the present invention.

Referring to FIG. 1, there is shown a sewing machine or sewing gauge 10 representing a preferred constructed embodiment of the present invention. Sewing machine 10 is directed to positioning a line of stitches on a workpiece, for example an upholstery cover or a garment, with a high degree of precision. Sewing machine 10 preferably includes a machine body 12 mounted to a base plate 14. Sewing machine 10 is preferably electrically powered and includes an internal electric motor (not shown) housed within machine body 12, and is connectable to a conventional power supply with an electrical plug 34. The internal electric motor powers a reciprocable needle bar assembly 16, which includes a presser bar 20, a presser foot 18, and a sewing needle 22 which is reciprocable between an upward/retracted position and a downward position in a conventional manner. The means for translating or feeding the workpiece, and means for reciprocation of the needle are preferably operably linked, in a manner well known in the art, allowing the needle to serially pierce the workpiece at substantially equal intervals as the workpiece is fed past the needle. During reciprocation toward its downward position, a tip of needle 22 is positioned such that it can pierce a workpiece "W", typically a piece or pieces of fabric, which is preferably passed along base plate 14, and passes a sewing "thread" or strand through the workpiece at a plurality of positions, the plurality of positions defining a stitching line.

In FIG. 1, the dashed line "Z" represents a target position for the stitching line yet to be sewn onto workpiece W, while the cross-marked line "X" represents the portion of the stitching line already completed. It should be appreciated that line Z is included for illustrative purposes, and merely represents the path along which an operator wishes to position the stitching line. In a preferred embodiment, the present invention does not require a visible line placed on the workpiece, however, in certain applications the operator may wish to draw or print a stitching reference line on the workpiece. The present invention might even utilize a projected illuminated image as a stitching reference. Preferably, however, the workpiece edge "E" serves as the stitching reference, as explained herein. A conventional workpiece feeding mechanism (not shown) is preferably included in sewing machine 10, and anchored to base plate 14, driving workpiece W in a feed direction represented by arrow "A" in FIG. 1. The present invention also provides a plurality of illuminable units or lamps positioned on a lamp module 24, preferably fixed to base plate 14. It should be appreciated that as used herein, "lamp" refers to any suitable known illuminable indicator such as an LED, or an incandescent, fluorescent, or other type of light. The plurality of lamps preferably includes a green lamp 26 and a red lamp 28 which are connected to an electrical power supply with connector lines 30. Lamps 26 and 28 may be standard, colored incandescent bulbs, however, light-emitting diodes, or some other suitable illuminable units might be used.

Figure 2:
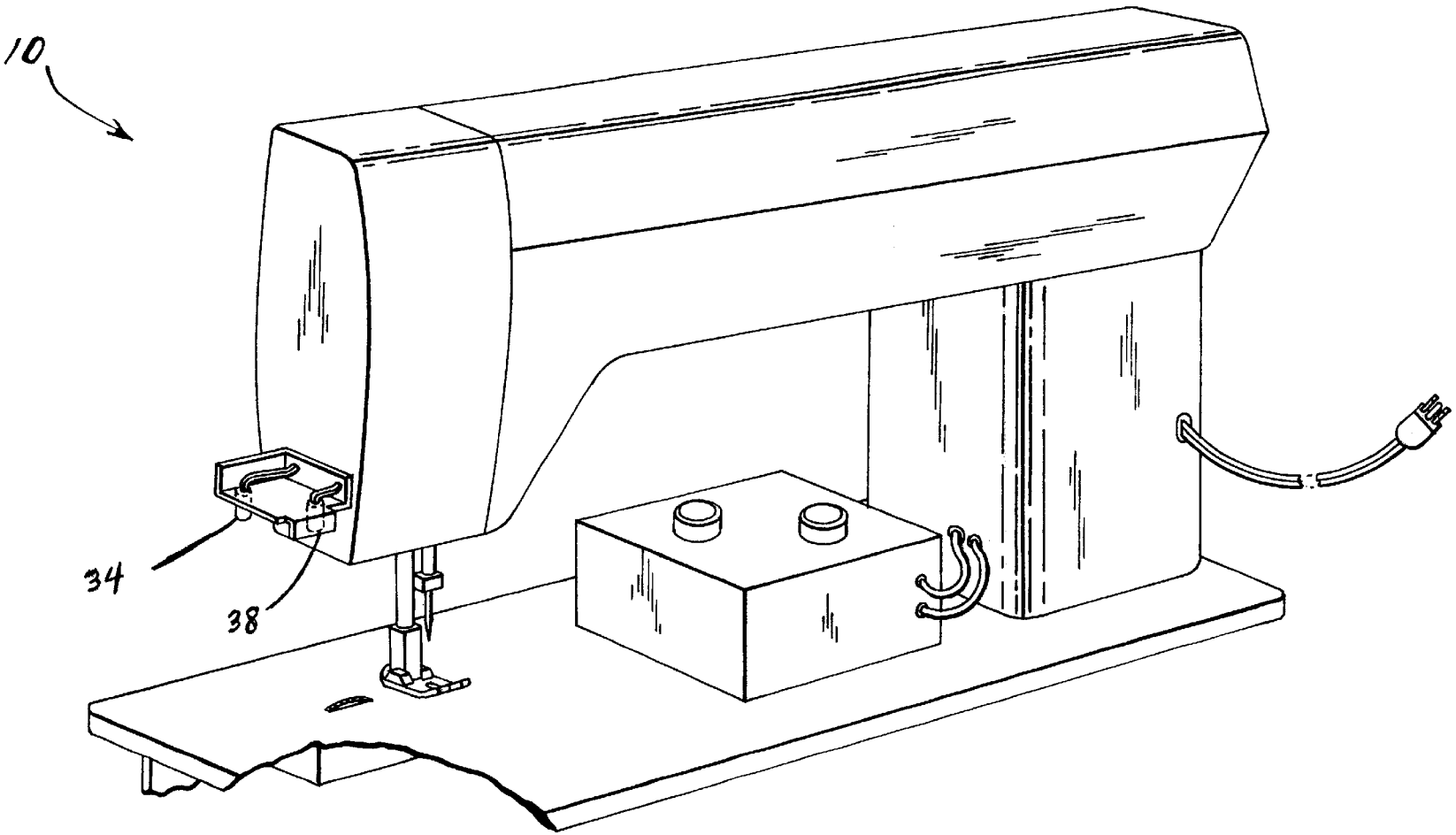
FIG. 2 is a perspective view of a sewing machine according to another preferred embodiment of the present invention.
Figure 3:
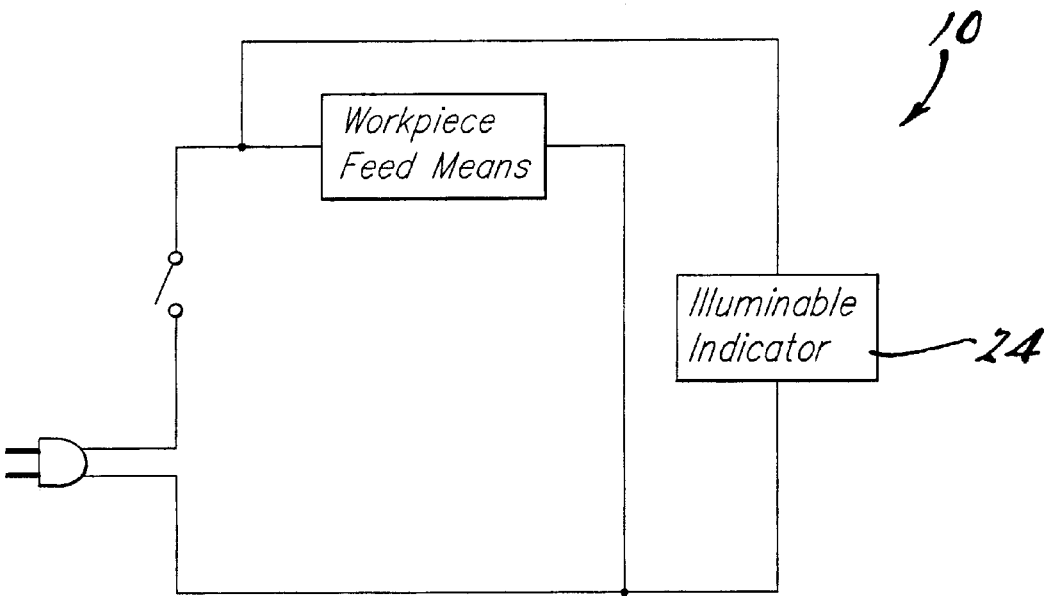
FIG. 3 is a schematic view of a sewing apparatus according to a preferred embodiment of the present invention.
Figure 4:
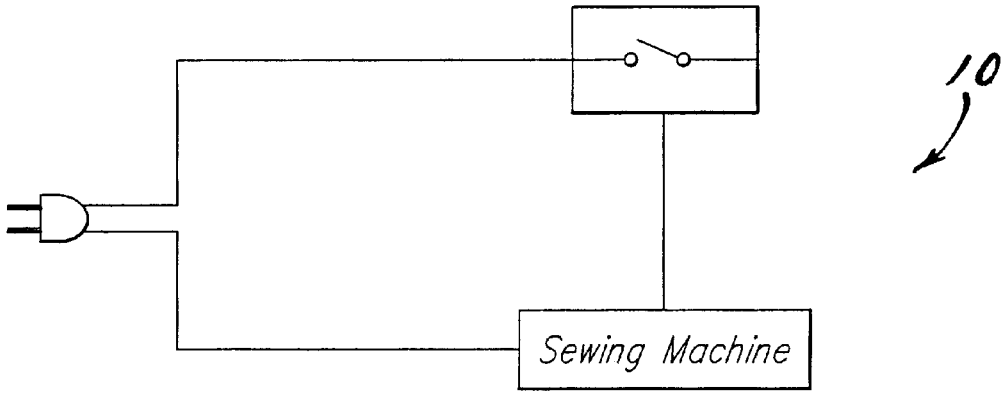
FIG. 4 is a schematic view of a sewing apparatus according to a preferred embodiment of the present invention.

A position detector (see FIG. 2), which can be any suitable detector such as a reflected-microwave optical position detector, is provided and preferably positioned in an end casing 32 of machine body 12. The position detector generates an electrical signal that represents a lateral position of workpiece W with respect to needle 22 (and hence stitching line X). For example, the detector may comprise a concave reflective surface positioned on base plate 14, a microwave emitter 36 positioned on machine body 12 at end casing 32, and a microwave receiver 38 also positioned at end casing 32 to measure a magnitude of microwave radiation reflected back by the reflective surface. As workpiece W is moved along base plate 14, its edge "E" passes over the reflective surface. If workpiece W moves laterally with respect to the feed direction to cover more or less of the reflective surface, the magnitude of reflected microwave radiation changes. By converting this magnitude to an electrical signal, the lateral position of workpiece W may be monitored. An exemplary optical position detector for generating an electrical signal in response to the position of a workpiece edge is disclosed in U.S. Pat. No. 4,823,716 to Nakashima, herein incorporated by reference. It should be understood that detectors substantially different from the one described might be used without departing from the scope of the present invention.

If the relative distance from the actual stitching line X to the stitching reference varies by no more than a predetermined magnitude, i.e. the stitching line is positioned within its tolerance specifications, a first condition exists. At this first condition, the optical position detector generates an electrical signal corresponding to within-tolerance stitching, that is communicated to lamp module 24, illuminating a first of its plurality of lamps 26, preferably green lamp 26. Thus, the relative distance between the stitching line and the workpiece reference, e.g. the workpiece edge E can vary by a certain magnitude, preferably plus or minus about 1 millimeter, without changing the illumination state of lamp module 24. However, if the operator allows the stitching line X to drift beyond the selected stitching position by more than the predetermined tolerance, a second condition exists, representing out-of-tolerance stitching. Stated another way, the sew tolerance is the maximum distance the actual stitching/stitching line should vary from operating specifications. Thus, within-tolerance stitching occurs so long as the actual stitching line lies less than the predetermined tolerance from the specified stitching line. Out-of-tolerance stitching occurs when the actual stitching line is positioned a greater distance from the specified/desired stitching line than the predetermined tolerance. When the sew tolerance is exceeded, the optical position detector generates an electrical signal corresponding to out-of-tolerance stitching, that is communicated to lamp module 24, which illuminates a second of its plurality of lamps 28, preferably red lamp 28.

It should be appreciated that the presently disclosed lighting scheme is not the only possible scheme by which the present invention can inform an operator of stitching conditions. For example, in an embodiment with only a single lamp (not shown), the first condition, i.e. within-tolerance stitching, may be represented to an operator by maintaining the lamp in an illuminated state, while out-of-tolerance stitching can be represented to the operator by de-energizing the lamp. An embodiment is also contemplated in which lamp 26 remains illuminated when lamp 28 is energized, as well as an embodiment in which lamp 26 is de-energized when lamp 28 is energized to signal out-of-tolerance stitching. The disclosed colors of lamps 26 and 28 might be varied without departing from the scope of the present invention, and it is not in fact necessary that they be colored at all.

In the preferred embodiment, the workpiece edge E is utilized as the reference from which to measure in or out-of-tolerance conditions. In FIG. 1, "T-1" represents a desired tracing width from the edge E. When the actual distance from the stitching line to E varies from T-1 by more than the preset tolerance, i.e. is less than the minimum stitching distance from edge E or greater than the maximum stitching distance from edge E, illumination of the second lamp 28 is triggered. So long as the operator maintains the position of the stitching line within the tolerance specifications, however, only the green lamp 26 is illuminated. When out-of-tolerance conditions are encountered, the machine operator can continue to sew, manually urging the workpiece back to within-tolerance conditions, indicated by de-illumination of red lamp 28. Alternatively, sewing can be halted, and the workpiece adjusted laterally to return the stitch positioning to the proper alignment. Control over operation of the sewing machine can be accomplished by any known method, such as a manually operable foot pedal or even voice activation. In an alternative embodiment (not shown), a kill-switch is incorporated with sewing machine 10, and shuts off power to the workpiece feed when the tolerance is exceeded. In this embodiment, the kill switch may be operably coupled to illumination of the second lamp 28, halting machine operation when lamp 28 is illuminated. The present invention allows stitching within a tolerance of approximately plus or minus 1 millimeter, however, sewing machine 10 may find application in environments in which it is unnecessary to stitch within a tolerance as small as plus or minus 1 millimeter, or in environments requiring even lesser tolerances.

A further alternative embodiment contemplates the use of dashed line Z as the stitching reference. In this embodiment, rather than using the workpiece edge E as the stitching reference, and setting a tracing width therefrom, a line on a workpiece itself serves as the stitching reference from which to set the sewing tolerance. In FIG. 1, T-2 represents the range within which the stitching line X can be placed without deviating from specifications. Thus, so long as the operator stitches within the range represented by T-2, lamp 26 alone will be illuminated. Deviations from line Z in either direction that exceed the predetermined tolerance induce illumination of second lamp 28. This embodiment would prove useful in pattern stitching applications, where it is desirable to follow a pattern, either projected onto the workpiece or programmed into the sewing machine. For example, where a decorative stitching pattern is desirable, the pattern would first be programmed into a computer in the sewing machine. The operator would then manipulate the workpiece and stitching assembly to stitch the pattern on the workpiece. The unique illuminating feature of the present invention could be used to guide the operator in positioning stitches along the desired route to produce the pattern. A further application would exist in stitching a reinforcing set of stitches a certain distance from a seam centrally located on a workpiece. In this environment, a workpiece edge might be too remote from the stitching location to be suitable as a stitching reference, and the seam itself could be used as the stitching reference for positioning the stitching line.

Thus, according to the present invention, a sewing machine operator can manually control the lateral positioning of a workpiece to ensure that stitches are spaced a very precise distance from a workpiece edge, or some other stitching reference on a workpiece such as a central seam or pattern. Other embodiments contemplate lateral adjustment of the workpiece by controlling a lateral feed drive to move the workpiece or, alternatively, laterally move the reciprocable needle bar assembly 16 to return the stitch positioning to within tolerance conditions. In still another embodiment, the present invention can be used to ascertain when a workpiece is properly positioned for the initiation of stitching. No lamps are illuminated so long as the workpiece W is not properly positioned. The green lamp is illuminated when the operator has positioned the workpiece properly, for example, when the needle is positioned such that the stitching line will be initially located within the predetermined tolerance. This embodiment assists the machine operator in initially positioning the workpiece prior to initiating stitching.

It should be understood that the present description is for illustrative purposes only and is not intended to limit the scope of the present invention in any way. Thus, those skilled in the art will appreciate that various modifications could be made to the presently disclosed embodiments without departing from the scope and spirit of the present invention. Other aspects, features, and advantages will be apparent upon an examination of the attached drawing figures and appended claims.

What is claimed:

1. A sewing machine comprising:

a machine body;

a sewing needle reciprocably mounted with said machine body, said sewing needle movable between a retracted position and an extended position at which a tip of said needle is positioned to pierce a translating workpiece, thereby passing a sewing strand therethrough, successive piercings of the workpiece defining a stitching line;

a detector for determining a lateral position of the stitching line relative to translation of the workpiece;

a plurality of lamps operably linked to said detector;

wherein illumination of a first of said lamps occurs during a first condition wherein said stitching line is positioned less than a predetermined tolerance distance from a selected position, and illumination of a second of said plurality of lamps occurs during a second condition wherein said stitching line is positioned greater than the predetermined tolerance distance from the selected position.

2. The sewing machine of claim 1 wherein said first lamp and said second lamp are different colors.

3. The sewing machine of claim 2 wherein said first lamp is a green lamp, and said second lamp is a red lamp.

4. The sewing machine of claim 1 wherein said first lamp is illuminated when the distance from said stitching line to the selected position is less than about 1 millimeter, and said second lamp is illuminated when the distance from said stitching line to the selected position is greater than about 1 millimeter.

5. The sewing machine of claim 1 wherein said selected position on said workpiece is a line defined as the set of points substantially equidistant from an edge of said workpiece.

6. The sewing machine of claim 1 wherein said selected position on said workpiece is a stitching pattern.

7. The sewing machine of claim 1 further comprising a kill-switch for interrupting machine operation when said distance from said stitching line to said selected position is greater than said predetermined tolerance distance.

8. A sewing gauge comprising:

a sewing machine having a machine body;

a needle mounted in said machine body and reciprocable between an upward retracted position and a downward position at which said needle is positioned to pierce a workpiece;

workpiece feed means operably linked to a reciprocation of said needle, said workpiece feed means translating the workpiece past said needle, wherein said needle can serially pierce the workpiece, the serial piercings defining a stitching line;

an illuminable indicator operable to a first state when a lateral distance from the stitching line to an edge of the workpiece is greater than a first distance and less than a second distance, said illuminable indicator operable to a second state when a lateral distance from the stitching line to the edge is less than the first distance or greater than the second distance.

9. The sewing gauge of claim 8 wherein said illuminable indicator comprises a plurality of light emitting diodes.

10. The sewing gauge of claim 8 further comprising a lateral feed for moving said workpiece in a direction substantially perpendicular to the orientation of the stitching line.

11. The sewing gauge of claim 8 further comprising a switch having a first state in which it provides electrical power to the workpiece feed means, said switch having a second state in which it interrupts electrical power to said workpiece feed means.

12. The sewing gauge of claim 11 wherein said switch is operably coupled to said illuminable indicator.

13. The sewing gauge of claim 8 wherein one of said first and said second illuminated states is an un-illuminated state.

14. An edge tracing sewing machine comprising:

a machine body;

a reciprocable needle mounted in said machine body and movable between a retracted position and an extended position at which said needle is positioned to pierce a workpiece;

a fabric feeder for feeding the workpiece relative to said needle such that during continual reciprocation, the needle pierces the workpiece plural times, thereby defining a stitching line;

a detector for detecting a lateral distance from a workpiece edge to said needle;

illuminating means for communication with an operator, said illuminating means having plural illuminated states;

said illuminating means have a first illuminated condition when a lateral distance from said needle to the workpiece edge is greater than a first distance and less than a second distance; and said illuminating means have a second illuminated condition when a lateral distance from said needle to the workpiece edge is less than the first distance or greater than the second distance.

15. The edge tracing sewing machine of claim 14 wherein said illuminating means have an un-illuminated condition when the workpiece is improperly positioned.

16. The edge tracing sewing machine of claim 14 wherein the first illuminated state is the illumination of a first lamp, and the second illuminated state is the un-illumination of said first lamp and illumination of a second lamp.

17. The edge tracing sewing machine of claim 14 wherein the first illuminated state is the illumination of a first lamp, and the second illuminated state is a simultaneous illumination of said first lamp and a second lamp.

18. A method of positioning a stitching line within a predetermined range of distances from a workpiece edge, the method comprising the steps of:

selecting a distance range for positioning a stitching line laterally of a workpiece edge, the distance range comprising distances from the workpiece edge between a minimum distance and a maximum distance;

feeding a workpiece past a reciprocable needle in a sewing machine, the sewing machine being operable to serially pass an end of the needle through the translating workpiece, forming stitches therethrough;

detecting a lateral position of the stitches relative to an edge of the workpiece;

operating an illumination means to a first state when the stitches are positioned greater than the minimum distance and less than the maximum distance from the workpiece edge;

operating the illumination means to a second state when the stitches are positioned less than the minimum distance or greater than the maximum distance from the workpiece edge.

19. The method of claim 18 wherein the step of operating the illumination means to a first state comprises illuminating a green lamp.

20. The method of claim 18 wherein the step of operating the illumination means to a second state comprises illuminating a red lamp.

* * * * *